US006269600B1

(12) United States Patent
Tambakakis

(10) Patent No.: US 6,269,600 B1
(45) Date of Patent: Aug. 7, 2001

(54) CURTAIN WALLS WITH SUSPENDED GLASSED PANELS

(76) Inventor: Stefanos Tambakakis, 59 Epidavrou Street, GR-15233 Halandri (GR)

( * ) Notice: Subject to any disclaimer, the term of this patent is extended or adjusted under 35 U.S.C. 154(b) by 0 days.

(21) Appl. No.: 09/269,224

(22) PCT Filed: Oct. 14, 1997

(86) PCT No.: PCT/GB97/00036

§ 371 Date: Mar. 23, 1999

§ 102(e) Date: Mar. 23, 1999

(87) PCT Pub. No.: WO98/16701

PCT Pub. Date: Apr. 23, 1998

(30) Foreign Application Priority Data

Oct. 16, 1996 (GR) ..... 960100356

(51) Int. Cl.[7] ..... E04B 1/00
(52) U.S. Cl. ..... 52/235; 52/506.05; 52/506.06
(58) Field of Search ..... 52/435, 235, 506.05, 52/506.06

(56) References Cited

U.S. PATENT DOCUMENTS 3,110,131 * 11/1963 Jeffress ..... 52/435
3,715,848 * 2/1973 Jordan ..... 52/435

FOREIGN PATENT DOCUMENTS 24 02 474 A1 * 7/1975 (DE) ..... 52/435
2153872A 8/1985 (GB) .
84/03117 8/1984 (WO) .

* cited by examiner

*Primary Examiner*—Carl D. Friedman
*Assistant Examiner*—Narko Slack
(74) *Attorney, Agent, or Firm*—Roylance, Abrams, Berdo & Goodman, L.L.P.

(57) ABSTRACT

A curtain wall of a predetermined height includes prefabricated glassed panels, and a frame. The frame has only horizontal beams into which the glassed panels are placed for supporting the glassed panels without continuous vertical beams existing along the height of the curtain wall on a building with multiple floors.

8 Claims, 8 Drawing Sheets

FIG.1a
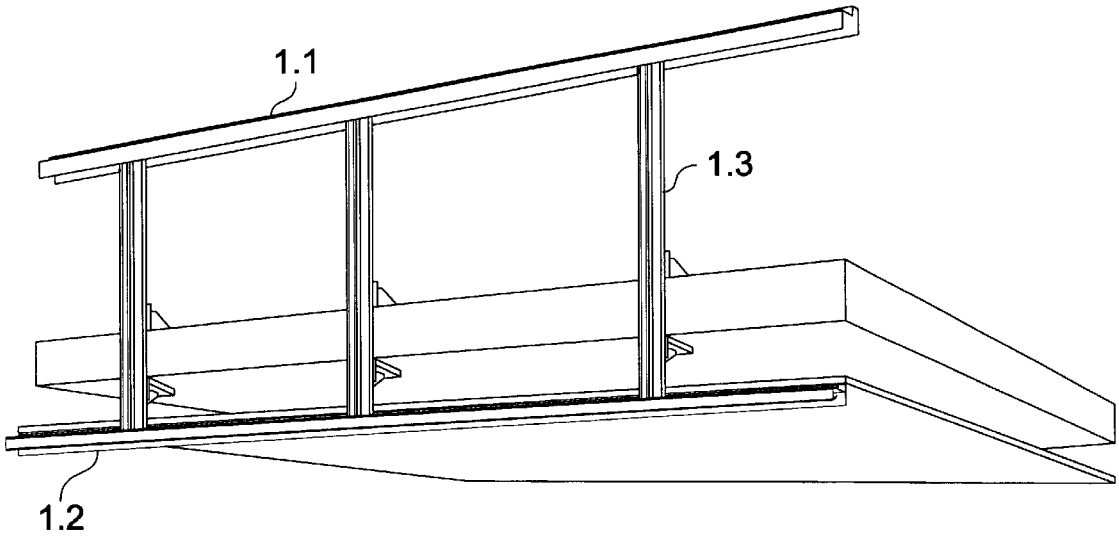
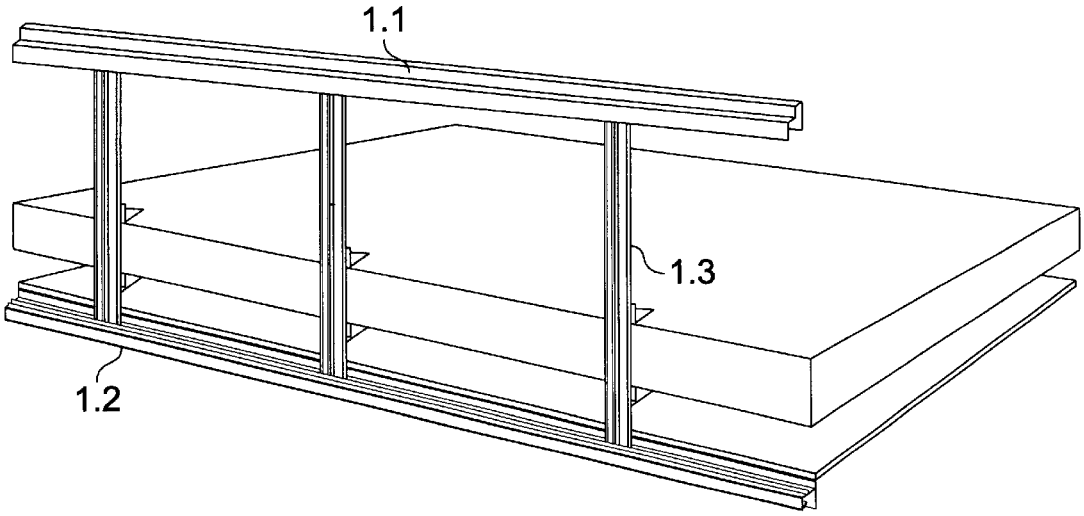
FIG.1b

CURTAIN WALLS WITH SUSPENDED GLASSED PANELS

FIELD OF THE INVENTION

The present invention involves the industrial production of a series of aluminum profiles for the construction of curtain walls with suspended glassed panels.

BACKGROUND OF THE INVENTION

The structure and shape of the frame of the curtain walls manufactured today in Greece and internationally are based on the traditional structure of the frame with a grid of vertical beams. The vertical beams extend across all the height of the curtain wall as continuous beams. Small horizontal beams transverse and are positioned between the vertical ones. The glassed panels are placed onto this grid in contact both with the vertical and the horizontal elements, and are supported by it.

This structure of the frame has several problems and weaknesses, mainly concerning thermal expansion, antiseismic properties, tightness, safety and operation of the windows, strength and durability of the sealing materials, the general construction cost, etc.

SUMMARY OF THE INVENTION

The above problems and weaknesses are addressed efficiently with the construction of curtain walls with suspended glassed panels, to which the present invention relates.

The objects of the present invention are basically obtained by a curtain wall of a predetermined height, comprising prefabricated glassed panels, and a frame having only horizontal beams into which the glassed panels are placed for supporting the glassed panels, without continuous vertical beams existing along the height of the curtain wall on a building with multiple floors.

With this invention, the elements of the glasses—glassed panels, prefabricated at the plant, are placed onto the frame of the curtain wall, and are suspended only from the horizontal beams of the frame along their whole length. The glassed panels do not touch the vertical beams. The vertical beams only support the horizontal beams onto the slabs of the floors of the building.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG.1 is a partial, perspective view of a frame for a curtain wall attached to floor slabs of a building;

DETAILED DESCRIPTION OF THE INVENTION

Figure 2:
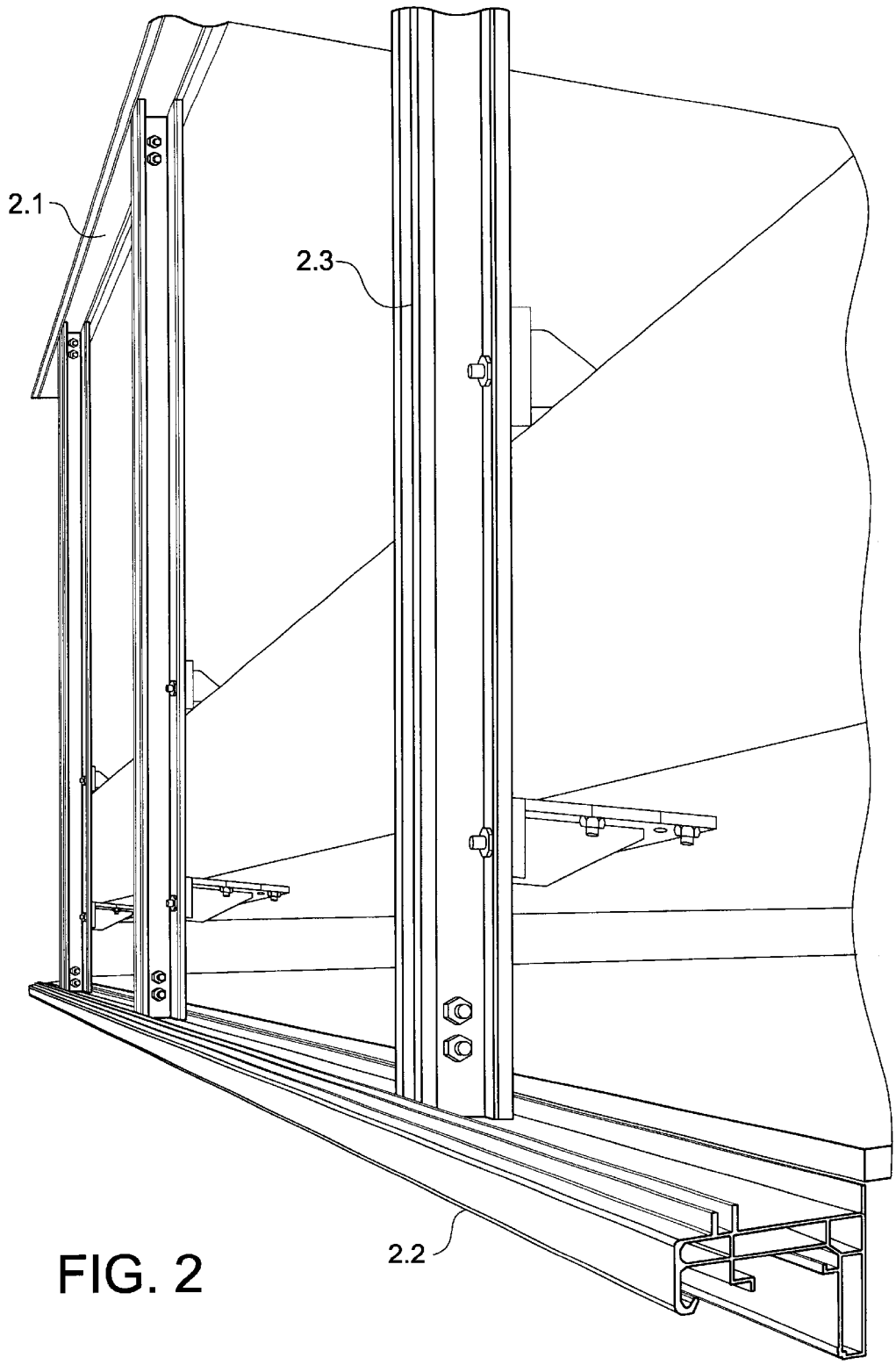
FIG. 2 is an enlarged, partial, perspective view of the frame of FIG. 1.

Each floor of the curtain wall has two horizontal beams parallel to each other and continuous, along the length of the structural facade of the floor. One horizontal beam 1.1, 2.1 is at the height of the base of the windows, the lower horizontal beam of the floor (FIGS. 1 and 2). The other horizontal beam 1.2, 2.2 is at the same height as the top of the windows, the upper horizontal beam of the floor (FIGS. 1 and 2).

These horizontal beams are supported on the ends of small cantilevers 1.3, 2.3 anchored on the slabs of the floors of the building. The cantilevers are fastened on the floor slab of the floor and have upwardly directed supports at their ends for the horizontal beam at the same height as the base of the windows, the lower horizontal beam of the floor. The cantilevers fastened to the roof slab of the floor also have downwardly directed supports at their ends for the horizontal beam at the same height as the top of the windows, the upper horizontal beam of the floor which constitutes the beam for the suspension and opening of the windows. The upper horizontal beam has special hooks along its whole length. The hooks correspond to the respective hooks of the upper side of the frames of the windows.

In case of continuity of the curtain wall to a lower or upper floor, the two cantilevers 1.3, 2.3 are unified as beams bilaterally protruding towards the continuous floors (FIGS. 1 and 2). However, in the case of unified glassed panel along the height of each floor, the support of the horizontal beams is directly fastened at the roof and floor slabs of the floor.

Figure 3:
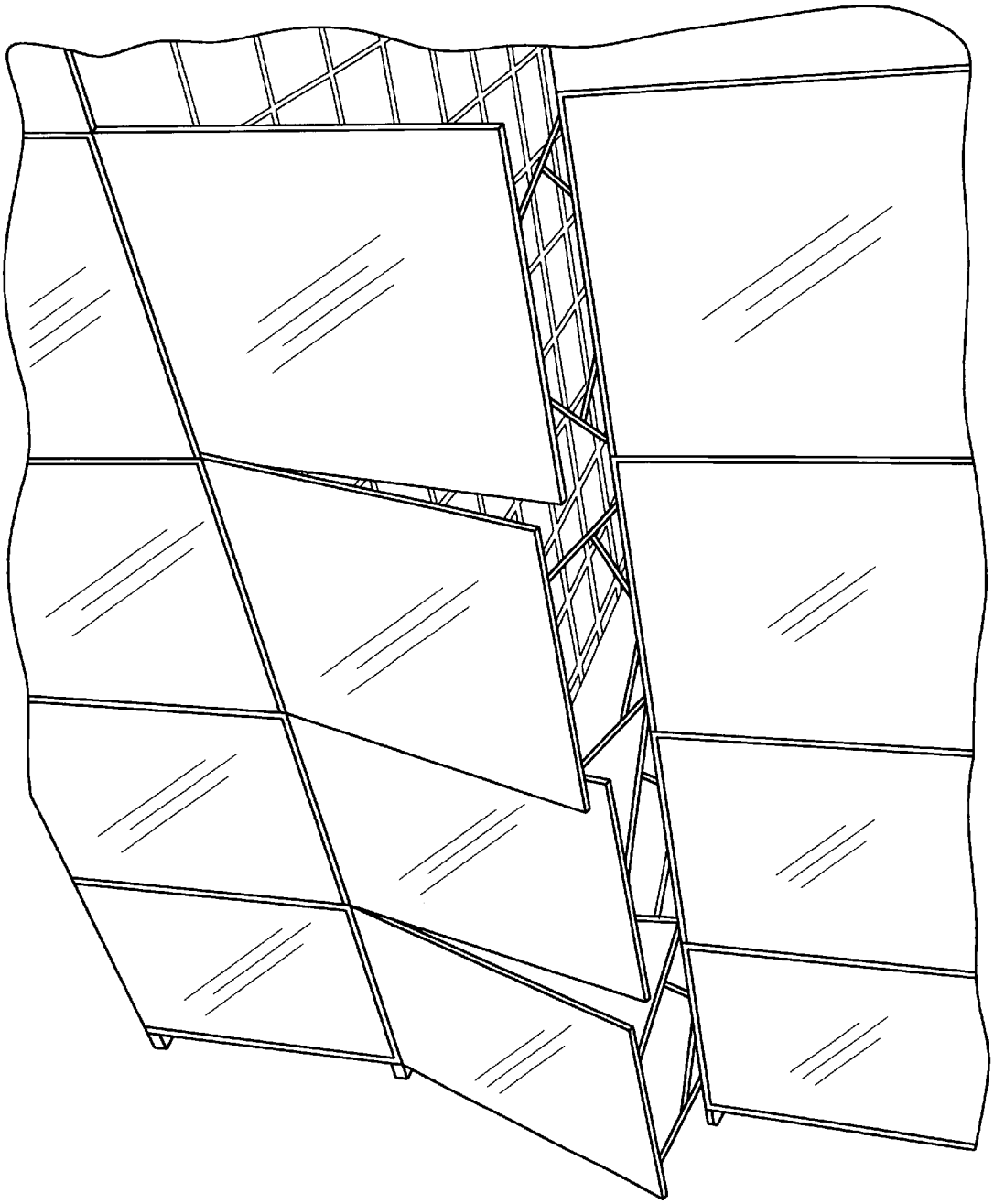
FIG. 3 is a partial perspective view of a building structure with glassed panels and the frame of FIG. 1.
Figure 4A:
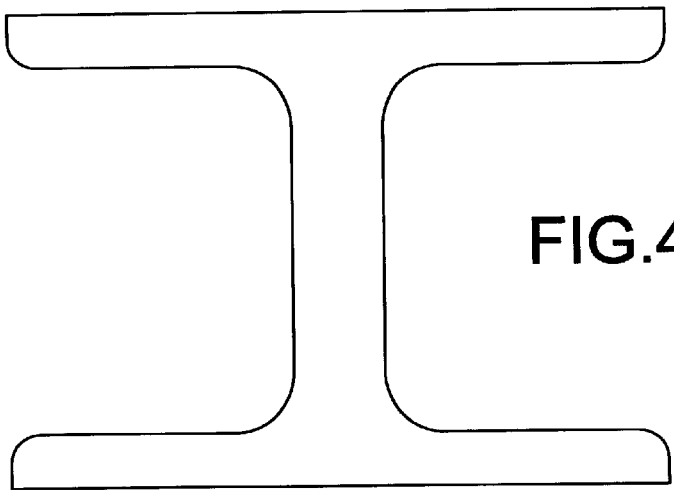
FIGS. 4 A–C are end elevational views of alternative profiles for the cantilevers for the frame of FIG. 1.
Figure 4B:
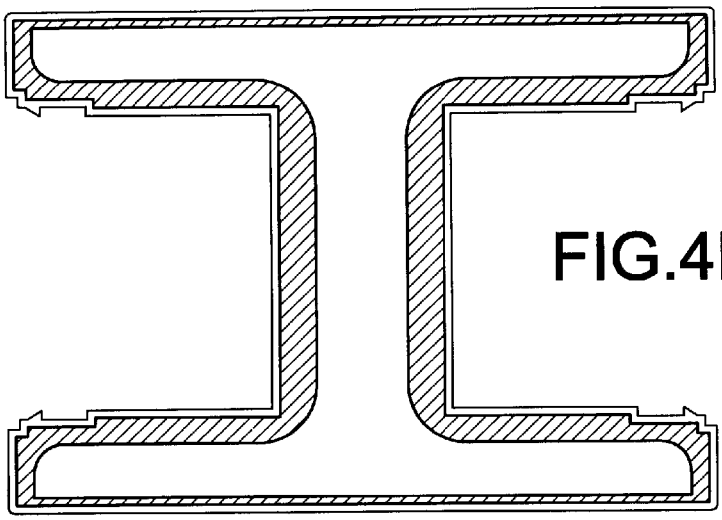
Figure 4C:
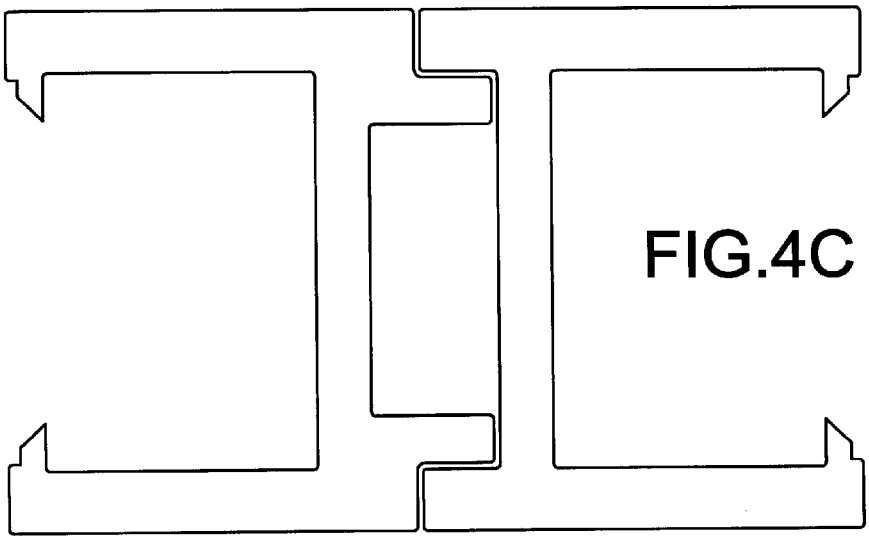

With the above support of the horizontal beams and the means of suspension and opening of the windows, continuity of vertical beams between the two horizontal beams of each floor does not exist. Hence, the construction of continuous windows along the length of the floor is easy and has a limited cost (FIG. 3).

The shape and the dimensions of the horizontal beams and cantilevers, the method of their connection and the fastening method depend on the materials of construction of the building and the dimensions of the slabs of the building.

Figure 5:
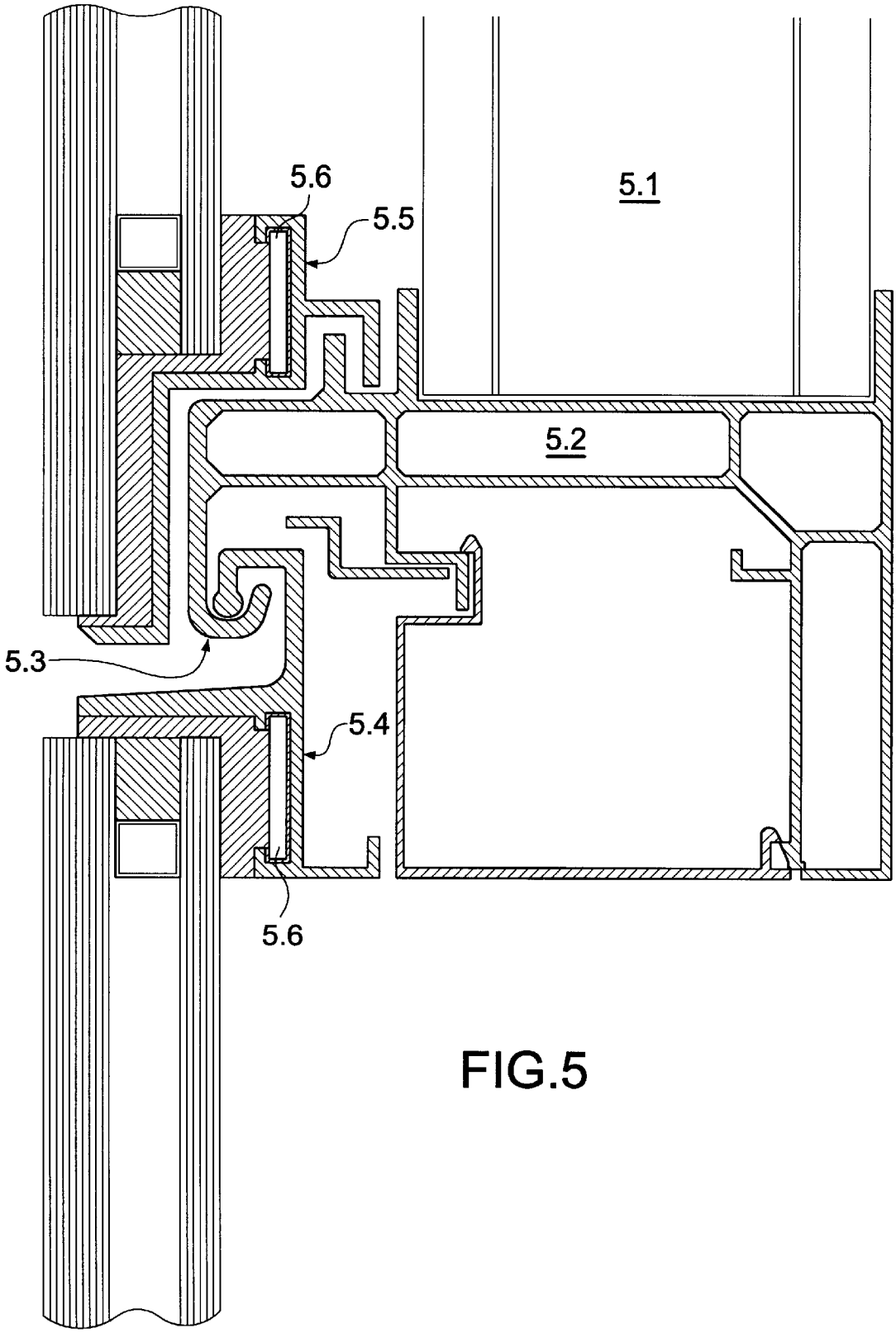
FIG. 5 is a partial, enlarged, side elevational view in section of the frame of FIG. 1 with glassed panels, at the upper horizontal beam.

Application of the present invention can constitute a series of aluminum profiles illustrated in FIGS. 4–7. FIGS. 4A–C illustrate profile forms of cantilevers, as in the embodiments of FIGS. 1 and 2. FIG. 5 illustrates the functional composition of the upper horizontal beam for the suspension of the windows in which cantilever 5.1 and upper horizontal beam 5.2 suspend the windows with hook 5.3. The upper horizontal side of the window frame has the mutual hook 5.4 for the suspension of the windows. The lower horizontal side 5.5 of the frame supports fixed glass panels.

Figure 6:
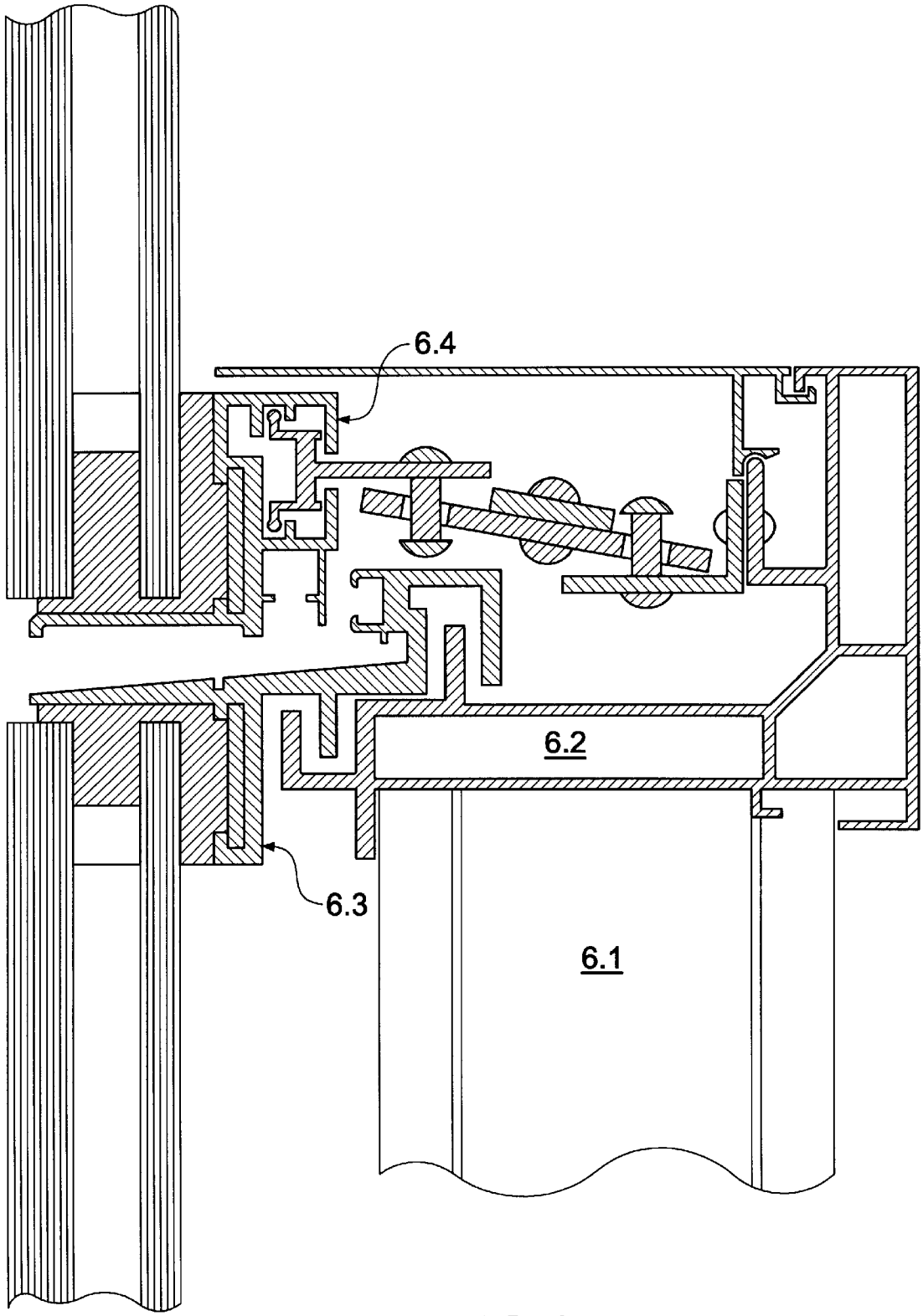
FIG. 6 is a partial, enlarged, side elevational view in section of the frame of FIG. 1 with glassed panels at the lower horizontal beam.

FIG. 6 illustrates the functional composition of the lower horizontal beam for the suspension of the fixed glass panels, and includes a cantilever 6.1, a lower horizontal beam 6.2 for the suspension of fixed glass panels, an upper horizontal side 6.3 of the frame of fixed glassed panels and a lower horizontal side 6.4 of the window frame.

Figure 7:
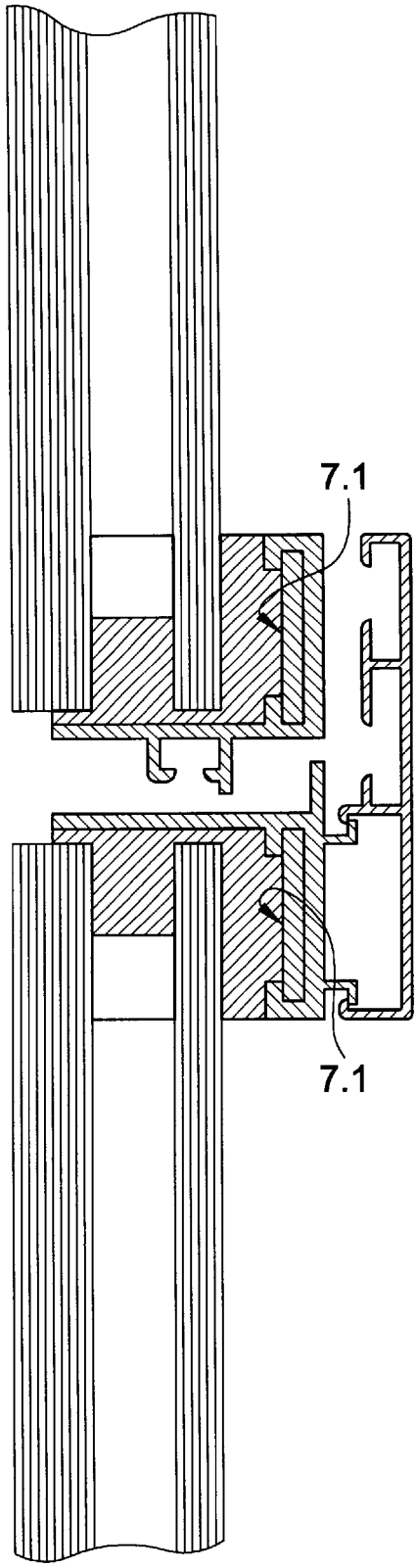
FIG. 7 is a partial, enlarged, side elevational view in section of a vertical beam and glassed panels according to the present invention.

FIG. 7 illustrates the functional composition of the vertical beam, with vertical sides of the frames for the windows and fixed glass panels.

Figure 8:
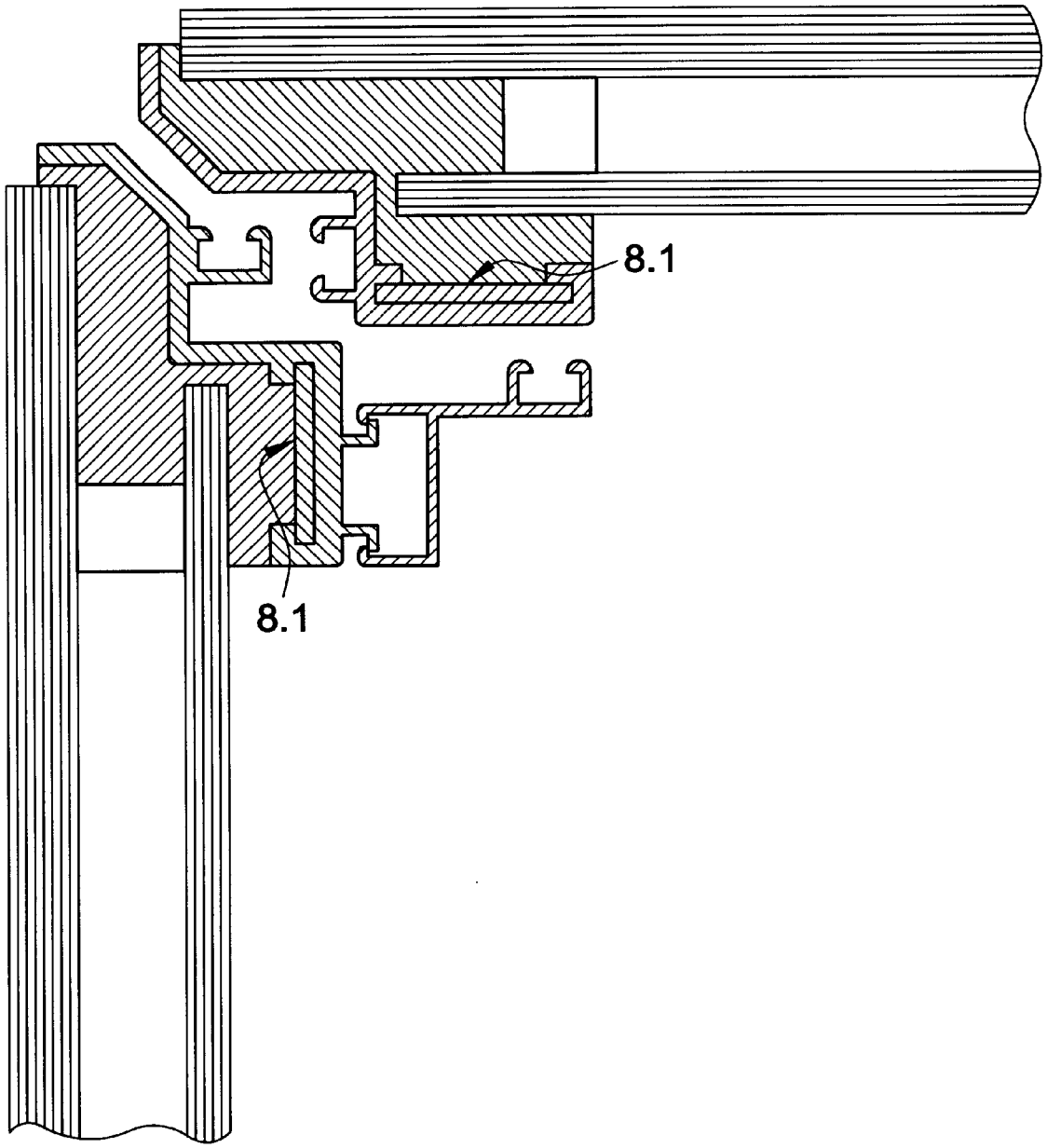
FIG. 8 is a partial, enlarged, top plan view in section at a corner of the curtain wall according to the present invention.

FIG. 8 illustrates the functional composition of a corner beam.

All the profiles, which constitute the panel of the glassed panels, bear special incisions for the attachment and support on them of aluminum blades made of special alloy compatible with the adherence requirements of the sealing materials. In this manner, a better quality and long lasting retention of the glasses onto the aluminum frames of the glassed panels, as illustrated in FIGS. 5–8, are provided.

While various embodiments have been chosen to illustrate the invention, it will be understood by those skilled in the art that various changes and modifications can be made therein without departing from the scope of the invention as defined in the amended claims.

What is claimed is:

1. In a building having multiple floors, a curtain wall of a predetermined height, comprising:

prefabricated glassed panels; and a frame having only horizontal beams supporting the glassed panels without continuous vertical beams existing along the height of the curtain wall said frame comprises first and second horizontal beams for each said floor of the building wall, said first and second horizontal beams being parallel to each other and being continuous along an entire length of a structural facade of each said floor, each said first horizontal beam corresponding to a window base for the respective floor, each said second horizontal beam corresponding to a window top for the vertically adjacent floor; and cantilevers are anchored to a floor slab of each said floor, said cantilevers having first upwardly directed ends supporting said first horizontal beams and second downwardly directed ends for supporting said second horizontal beams.

2. A curtain wall according to claim 1 wherein said cantilevers for said floors are unified beams;

said horizontal beams are supported on said unified beams and extend bilaterally therefrom.

3. A curtain wall according to claim 1 wherein between upper and lower beams of said horizontal beams on each of said floors, no vertical beams exist; and in a free space between said upper and lower beams on each of said floors, said glassed panels are suspended by hooks on a profile of said upper beam for each said floor and on a profile of an upper side of said glassed panels.

4. A curtain wall according to claim 1 wherein said horizontal beams comprise aluminum profiles prefabricated with said glassed panels, said aluminum profiles bearing incisions for supporting blades of aluminum alloy compatible with adherence requirements of sealing materials that retain glass members onto the glassed panels.

5. A building structure, comprising a plurality of floors defined between a plurality of horizontal, vertically spaced floor slabs, said floor slabs having outside edges extending between upper and lower surfaces;

vertically extending cantilevers having upper and lower ends spaced by intermediate portions, said intermediate portions being coupled to said outside edges of said floor slabs with said upper end of each said cantilever being spaced above said upper surface of the respective floor slab and said lower end of said cantilever spaced below said lower surface of the respective floor slab;

first and second horizontal beams coupled to said upper and lower ends, respectively of said cantilevers; and glassed panels supported on said horizontal beams only without vertical beams extending vertically between laterally adjacent glassed panels.

6. A building structure according to claim 5 wherein said horizontal beams are parallel to and spaced between the respective floor slabs.

7. A building structure according to claim 6 wherein said first horizontal beams support bottom edges of said glassed panels; and said second horizontal beams support top edges of said glassed panels.

8. A building structure according to claim 5 wherein said glassed panels are supported along entire lengths thereof on said horizontal beams by elongated and continuous hooks on aluminum profiles attached to said glassed panels, without other attachment devices and connections.

* * * * *

UNITED STATES PATENT AND TRADEMARK OFFICE

CERTIFICATE OF CORRECTION

PATENT NO. : 6,269,600 B1
DATED : August 7, 2001
INVENTOR(S) : Stefanos Tambakakis It is certified that error appears in the above-identified patent and that said Letters Patent is hereby corrected as shown below:

Title page,
Item [86], reads "[86] PCT No. PCT/GB97/00036" should read
-- [86] PCT No. PCT/GR97/00036 --.

Signed and Sealed this

Twenty-sixth Day of April, 2005

JON W. DUDAS
*Director of the United States Patent and Trademark Office*